US010961732B2

(12) United States Patent
Barmettler

(10) Patent No.: US 10,961,732 B2
(45) Date of Patent: Mar. 30, 2021

(54) CONCRETE PENETRATION PATCH KIT AND METHOD

(71) Applicant: Mark Barmettler, Napa, CA (US)

(72) Inventor: Mark Barmettler, Napa, CA (US)

( * ) Notice: Subject to any disclaimer, the term of this patent is extended or adjusted under 35 U.S.C. 154(b) by 5 days.

(21) Appl. No.: 16/600,084

(22) Filed: Oct. 11, 2019

(65) Prior Publication Data

US 2020/0165831 A1 May 28, 2020

Related U.S. Application Data

(60) Provisional application No. 62/770,955, filed on Nov. 23, 2018.

(51) Int. Cl.
*E04G 23/02* (2006.01)

(52) U.S. Cl.
CPC ..... *E04G 23/0203* (2013.01)

(58) Field of Classification Search
CPC ... E04G 23/0203; E04G 23/0288; E04C 2/52; E02D 37/00
See application file for complete search history.

(56) References Cited

U.S. PATENT DOCUMENTS 4,370,842 A * 2/1983 Martin ..... E04G 23/0203 52/514
4,820,564 A * 4/1989 Cologna ..... B29C 73/14 156/98
5,257,486 A * 11/1993 Holmwall ..... B05C 7/00 52/514.5
7,836,659 B1 * 11/2010 Barnes ..... E04G 23/02 52/742.14
2004/0010985 A1 * 1/2004 Francies, III ..... E04G 15/04 52/125.4
2008/0229694 A1 * 9/2008 Ising ..... E04G 23/0207 52/514
2008/0313993 A1 * 12/2008 Reen ..... E04G 23/0203 52/718.01
2010/0037414 A1 * 2/2010 Dimos ..... E04G 23/0203 15/245.1
2011/0023395 A1 2/2011 Hoshi
2013/0312362 A1 * 11/2013 Maanum ..... E04G 23/0203 52/742.13
2015/0184406 A1 * 7/2015 Naylor ..... E04G 23/0203 52/514

(Continued)

*Primary Examiner* — Paola Agudelo
(74) *Attorney, Agent, or Firm* — Runyan Law; Charles Runyan

(57) ABSTRACT

A safe, time-saving, and effective way to repair abandon core holes in concrete slabs in buildings with multiple floors. The kit allows repairs to be performed from above the slab, rather than solely from below. It saves workers time and frustration while also lowering overtime costs for a greater return. The device holds poured cement in place with metal disks, rather than combustible materials, fiberglass insulation, or other makeshift materials, for maximum safety. The present invention uses a wire to secure plugs in cores, effectively preventing the plugs from falling out. Concrete penetration patch kit includes a concrete penetration patch kit is used by contractors to repair abandon core holes in concrete slabs. This innovative product is a concrete patch kit for use when patching any abandoned slab penetrations, including electrical, plumbing, and floor cores in concrete.

20 Claims, 5 Drawing Sheets

(56) References Cited

U.S. PATENT DOCUMENTS

| | | | | |
|---|---|---|---|---|
| 2016/0208505 | A1* | 7/2016 | Freeman | E04G 23/0288 |
| 2016/0265241 | A1* | 9/2016 | Maunder | E04G 23/0218 |
| 2016/0341357 | A1* | 11/2016 | Roberts | F16B 13/0808 |
| 2017/0370115 | A1* | 12/2017 | Gray | E04B 1/947 |

* cited by examiner

CONCRETE PENETRATION PATCH KIT AND METHOD

CROSS REFERENCE TO RELATED APPLICATION

The present application is related to and claims priority to U.S. Provisional Patent Application No. 62/770,955 filed Nov. 23, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of construction and more specifically relates to a concrete repairing tool.

2. Description of Related Art

Currently, contractors must access previously cored slabs from below for repair. Unfortunately, in buildings with multiple floors, accessing floors from below typically involves disrupting the business process of the affected tenants and is therefore relegated to after hours, which is not only frustrating and inconvenient for workers but also requires overtime, which can be costly for companies. Additionally, contractors typically fill cores without the benefit and safety of locking plugs in place, allowing them to fall out. Further, contractors typically collect makeshift materials on site to hold the concrete in place, but these materials are usually combustible, making it vulnerable to fire. Finally, typical core patches often result in an eyesore and diminish the overall aesthetic of the construction. A suitable solution is desired.

U.S. Pub. No. 2011/0023395 to Isao Hoshi relates to a floor slab penetration structure and floor slab penetration hole repair method. The described floor slab penetration structure and floor slab penetration hole repair method includes a floor slab penetration structure, comprising a penetration hole formed to a floor slab of a building under construction, the penetration hole is provided with a substantially cylindrical funnel portion opened to a floor surface of a room, a connection pipe is communicated to a bottom portion of the funnel portion, and a hose guide pipe is inserted to the lower end portion of the connection pipe. An inner flange portion is provided to the lower end portion of the hose guide pipe so as to be flash with a ceiling surface of the downfloor room.

BRIEF SUMMARY OF THE INVENTION

In view of the foregoing disadvantages inherent in the known construction art, the present disclosure provides a novel concrete penetration patch kit and method. The general purpose of the present disclosure, which will be described subsequently in greater detail, is to provide an effective method/means and kit for patching concrete penetration holes and applying fireproofing material.

A concrete penetration patch kit is disclosed herein. The concrete penetration patch kit comprising a setting tool including a setting-head, a setting-stem, and a drill guide, a first set of retainer discs, a second set of retainer discs, at least one setting wire, fireproofing material, and netting. The first set of retainer discs and second set of retainer discs comprise discs ranging from 1 inch to 7 inches in diameter. The selected disc of the first set of retainer discs is about 0.5 inch larger than the abandoned penetration hole being repaired. The selected one of the second set of retainer discs is about 0.5 inch smaller than the abandoned penetration hole being repaired. The concrete penetration patch kit is provided to repair an abandoned penetration hole in a concrete slab.

A method of using concrete penetration patch kit is also disclosed herein. The method of using concrete penetration patch kit may comprise the steps of: providing a concrete penetration patch kit including a setting tool including a setting-head, a setting-stem, and a drill guide, a first set of retainer discs, a second set of retainer discs, at least one setting wire, at least one depth control wire, at least one fastener, fireproofing material, netting, and a rubber mallet; measuring a width and depth of an existing penetration hole and selecting an appropriate size first-disc from the first set of retainer discs that is 0.5" larger than the abandoned penetration hole being repaired; selecting an appropriate size second-disc from the second set of retainer discs which is 0.5" smaller than the abandoned penetration hole being repaired; attaching one of the at least one setting wire to the first-disc; attaching a second one of the at least one setting wire to the second-disc forming an assembly; preparing the netting and the fireproofing material; setting the assembly including the first-disc and the second-disc within a penetration hole; adjusting and tightening the first-disc and second-disc; and pouring cement into the penetration hole.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a concrete penetration patch kit and method, constructed and operative according to the teachings of the present disclosure.

The various embodiments of the present invention will hereinafter be described in conjunction with the appended drawings, wherein like designations denote like elements.

DETAILED DESCRIPTION

Figure 1:
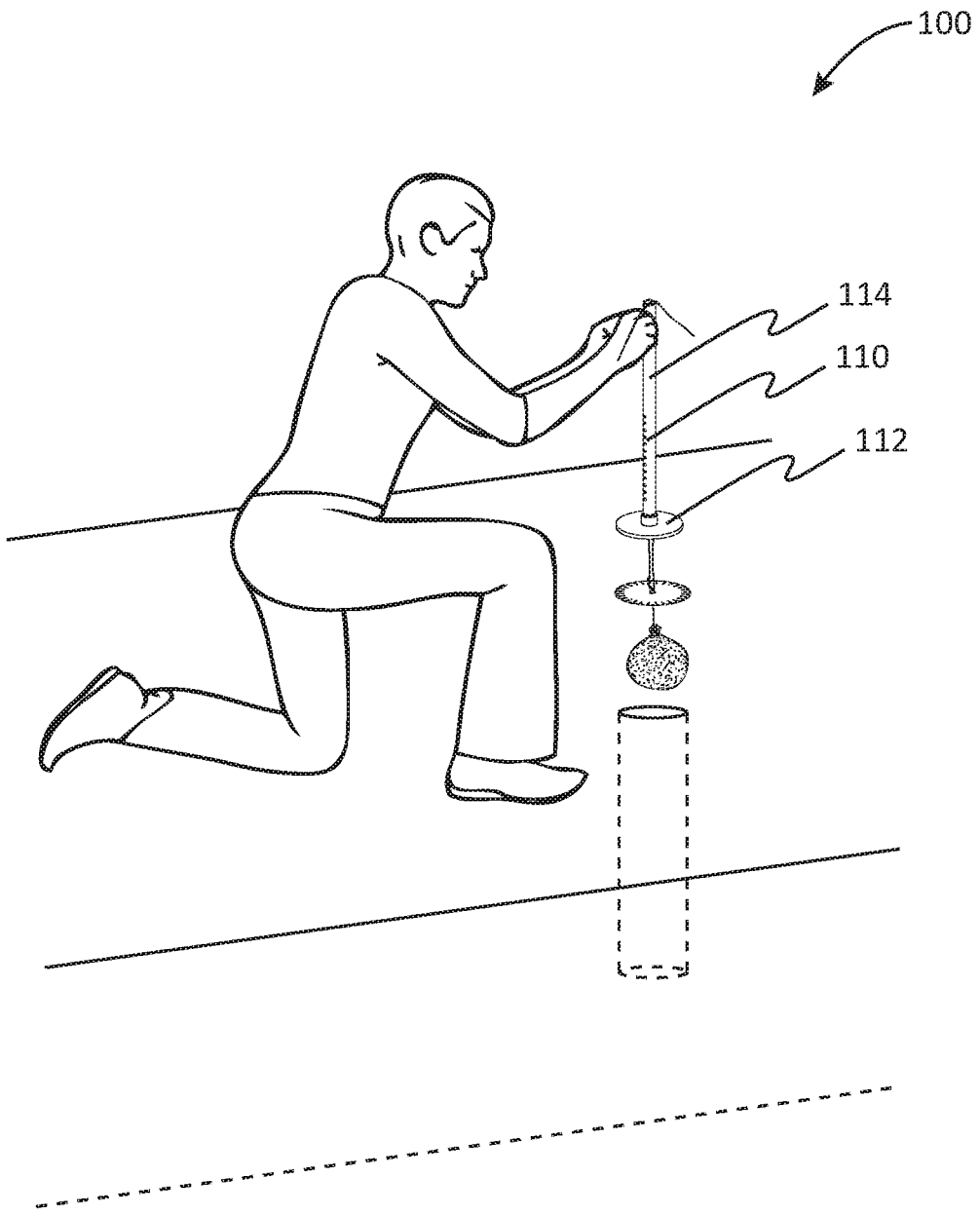
FIG. 1 is a perspective view of the concrete penetration patch kit during an 'in-use' condition, according to an embodiment of the disclosure.
Figure 2A:
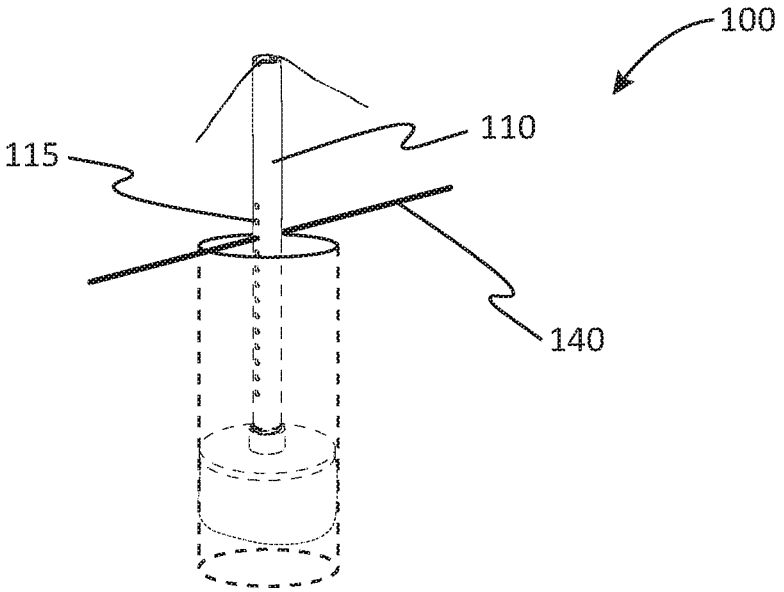
FIG. 2A is a perspective view of the concrete penetration patch kit of FIG. 1, according to an embodiment of the present disclosure.
Figure 2B:
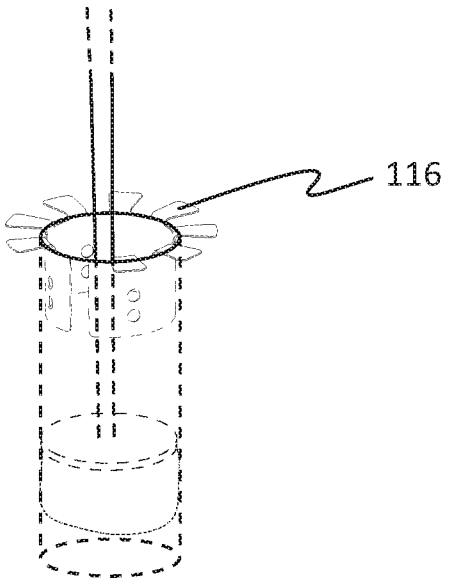
FIG. 2B is a perspective view of the concrete penetration patch kit of FIG. 1, according to an embodiment of the present disclosure.
Figure 3A:
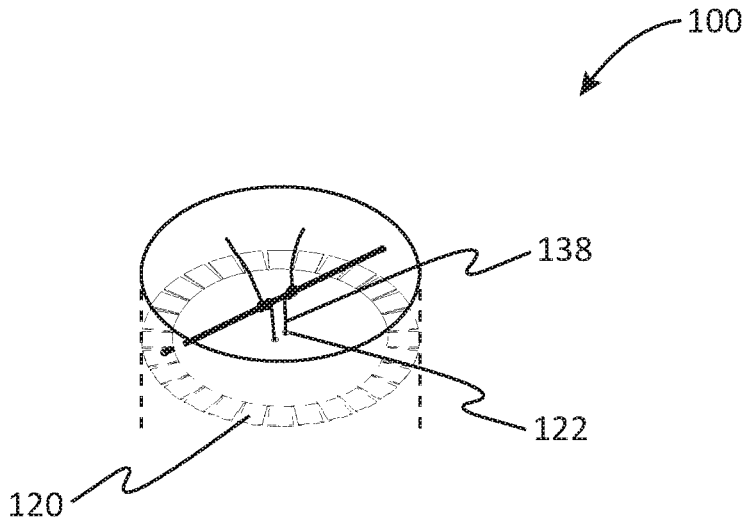
FIG. 3A is a perspective view of the concrete penetration patch kit of FIG. 1, according to an embodiment of the present disclosure.
Figure 3B:
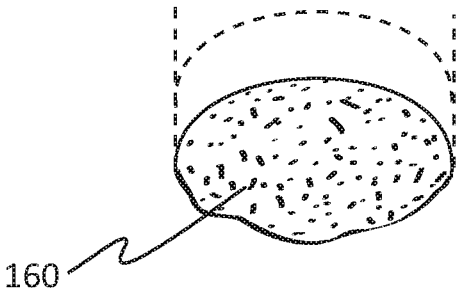
FIG. 3B is a perspective view of the concrete penetration patch kit of FIG. 1, according to an embodiment of the present disclosure.
Figure 4:
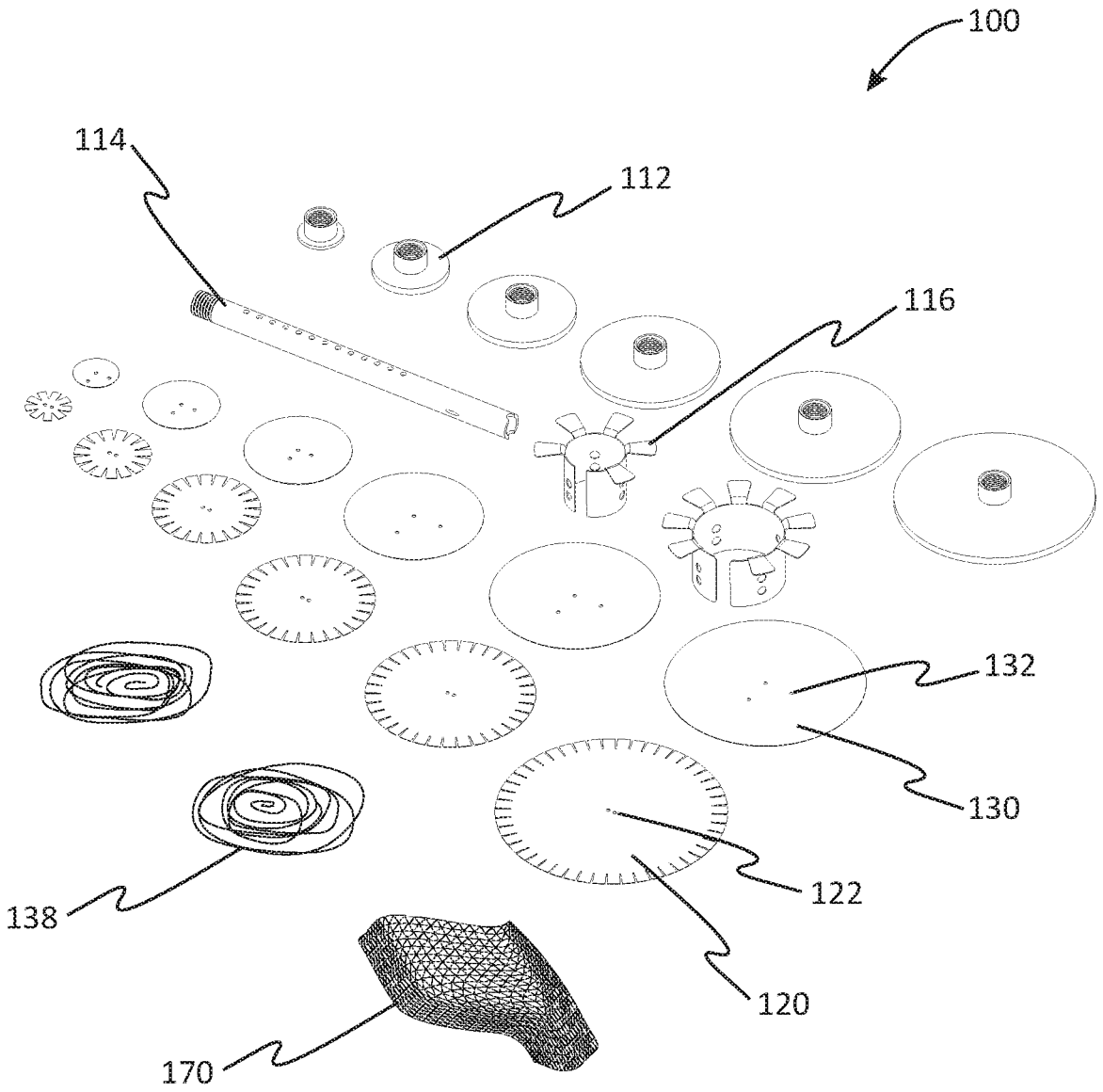
FIG. 4 is a perspective view of the concrete penetration patch kit of FIG. 1, according to an embodiment of the present disclosure.

As discussed above, embodiments of the present disclosure relate to construction and more particularly to a concrete penetration patch kit and method as used to improve the repairing, patching, and fireproofing of concrete. The kit may be used for patching abandon slab penetrations in concrete slab floors or roofs, including but not limited to electrical, plumbing/venting and data floor cores.

Generally, concrete penetration patch kit comprises of a metal setting tool with a selection of setting heads for 1" to 7" cores and 2 types of sheet metal discs that work in conjunction with them. A first set of retainer discs is engineered to be larger than the core hole to be patched and is laser cut to "cup" when set in a core hole. A second set of retainer discs is packed with fireproofing and suspended below a selected disc of the first set of retainer discs (on a wire) during setting, then pulled up tight against the bottom of the selected disc of the first set of retainer discs and secured there. The setting wires are tied off to a bridge wire set near the top of the core hole that functions as a "key" into the existing concrete deck to prevent core shear.

The present invention provides a safe, time-saving, and effective way to repair abandon core holes in concrete slabs in buildings with multiple floors. The kit allows repairs to be performed from above the slab, rather than solely from below. It saves workers time and frustration while also lowering overtime costs for a greater return. The device holds poured cement in place with metal disks, rather than combustible materials, fiberglass insulation, or other makeshift materials, for maximum safety. The present invention uses a wire to secure plugs in cores, effectively preventing the plugs from falling out. Concrete penetration patch kit includes a concrete penetration patch kit is used by contractors to repair abandon core holes in concrete slabs. This innovative product is a concrete patch kit for use when patching any abandoned slab penetrations, including electrical, plumbing, and floor cores in concrete.

Further, the patch kit can feature a core-plug setting tool, metal retainer disks, and a rubber mallet for driving the retainer disks to the required depth. Each setting tool can include a brass hammer cap, with a slot for the setting wire, that screws to the top of the setting tube to protect the threads and keep the setting process quieter. The setting tool may have holes drilled in the tube through which a setting gauge rod can be inserted to control the depth the retainer disk. The setting tool can be made with threaded tubing or pipe.

Additionally, setting heads for plugging cores can measure from (about) 0.75" to 5" in diameter. The setting heads are similar to pipe flanges or plumbing bell reducers. Further, the retainer disks, made from 25-gauge galvanized sheet metal, can be offered with a moisture-absorbing pad on one side and can be painted with intumescent paint on the other side. The moisture-absorbing pad prevents excess moisture from the cement mix from dripping into the tenant space below the core being patched. The intumescent paint on the bottom of the disks provides a measure of fire protection to the patched core. The size of the concrete retainer measures approximately 0.5" larger than the penetration to be patched. Also included in the kit can be a lightweight setting or safety wires, SAFETYBRIDGE 10-gauge wire, and a SAFETYBRIDGE drilling guide.

The discs are configured to be attached to one another and to prevent them from being pushed out of the core hole during the placing of the cement. Each one of the discs of the first set of retainer discs has a pair of small holes drilled into the center it that are used to attach a setting wire. The wire, once attached to the selected disc of the first set of retainer discs and connected with a setting wire of a selected disc of the second set of retainer discs, is fed up through the open center of the setting-stem and bent over into the depth control holes. Setting wire is included with the retainer disks.

The next part of the system is the second set of retainer discs and a process to apply replacement fireproofing material to the bottom of the selected disc of the first set of retainer discs. The system is the only one to provide a method to apply the fireproofing to the bottom of the concrete retaining disc from the floor above. The process for using the netting and packing the fireproofing material in it is as follows: After cutting the recommended length of netting, close one end of it with the provided zip tie. Allow ¼" of netting beyond zip tie. Invert netting on open hand with extended fingers with the zip tied end up. Using supplied serving spoon, put one scope of previously mixed fireproofing material (or less on small; 3" and under discs or as needed to cover the bottom of the selected disc of the second set of retainer discs) between the bottom of the selected disc of the second set of retainer discs and the zip tied netting, Pull the remaining netting over the disc so that it creates a bag on the top of the selected disc of the second set of retainer discs. Fill the bag with the remaining fireproofing product. Use a second provided zip tie to securely close the top of the netting around the setting wire of the selected disc of the second set of retainer discs. Shape the netting/fireproofing into a "cone shape" around the setting wire. Distribute the fireproofing to cover out to the edges of the selected disc of the second set of retainer discs.

The next step in the process is to feed the setting wire from the selected disc of the second set of retainer discs, up through the bottom of the selected disc of the first set of retainer discs using either hole allowing it to remain hanging about 4" below the selected disc of the first set of retainer discs. With the selected disc of the second set of retainer discs suspended below the selected disc of the first set of retainer discs, three loops are twisted loosely around the setting wire of the selected disc of the first set of retainer discs above the selected disc of the first set of retainer discs, to prevent the setting wire of the selected disc of the second set of retainer discs from slipping back down out of the selected disc of the first set of retainer discs.

Next, feed both of the setting wires up through the setting head on the setting stem and out the top. Identify which wire is for each disc. Core Plug recommends making the setting wire of the selected disc of the second set of retainer disc longer than the setting wire of the selected disc of the first set of retainer discs for easy identification. Pull the selected disc of the first set of retainer discs tight to the bottom of the setting head and bend both setting wires into the grooves provided in the top of the setting stem. Remember to leave the selected disc of the second set of retainer discs hanging 4" below the selected disc of the first set of retainer discs.

The next step is the set the selected disc of the first set of retainer discs in the abandon core penetration holding the setting stem and lower the selected disc of the second set of retainer discs into the core hole. Then, next set the selected disc of the first set of retainer discs on the floor centered on the core hole. Using a provided rubber mallet, drive the system down into the core hole until the depth wire lands on the concrete finish. Next, straighten the setting wires and pull the setting tool out of the hole. This will leave the selected disc of the first set of retainer discs cupped in the bottom of the core hole and the selected disc of the second set of retainer discs swinging in the air about 4" below it. (Be sure not to let the setting wire of the selected disc of the second set of retainer disc slip out of the #1 disc and fall to the space below. (Twist a loop in the setting wire of the selected disc of the second set of retainer discs, above the selected disc of the first set of retainer discs, to prevent the setting wire of the selected disc of the second set of retainer discs from slopping back down out of the selected disc of the first set of retainer discs.) Swabbing an inside of the to-be plugged core hole with concrete adhesive is recommended at this point in the process.

The next step is to set a Bridge wire: The Bridge wire is a cut-to-length section of hardened steel wire supplied with the discs. Using the provided drill guide, use a standard drill and drill one hole ½" deep on each side of the core hole. Use a provided Bridge wire and provided 8" bolt cutters to cut a section of Bridge wire to fit tightly across the core in the bottoms of the two holes, (it should be inserted to the full depth of the holes). Put one end into one of the holes and push down on the center of the Bridge wire until the other end of the wire drags down and slides into the second hole. With the Bridge wire set, cut a first setting wire about 2" above the top of the hole and bend the setting wire which connects a selected disc of the first set of retainer discs tightly over the bridge wire and wrap in one time around. Leave remaining wire pointing down. Next, pull up on setting wire which connects a selected disc of the second set of retainer discs firmly enough to compress the cone of fireproofing onto the bottom of the selected disc of the first set of retainer disc and cause the fireproofing material to squeeze out onto the bottom surface of the surrounding floor structure. While holding setting wire which connects a selected disc of the second set of retainer discs tight to bottom of selected disc of the first set of retainer discs, bend it over the Bridge wire and cut it off leaving enough wire the wrap the Bridge wire one time. Leave all wire ends pointing down. Next, pour and finish the cement in the patched core hole. Using high strength cement mixed according to the manufactures instructions is recommended.

Referring now more specifically to the drawings by numerals of reference, there is shown in FIGS. 1-5, various views of a concrete penetration patch kit 100. FIG. 1 shows a concrete penetration patch kit 100, according to an embodiment of the present disclosure. As illustrated, the concrete penetration patch kit 100 to repair abandoned penetration holes in concrete slabs includes a setting tool 110 featuring a setting-head 112, a setting-stem 114, and a drill guide 116, a first set of retainer discs 120, a second set of retainer discs 130, at least one setting wire 138, fireproofing material 160, and netting 170. The setting-heads 112 are provided in a variety of sizes to accommodate a corresponding selected disc of the first set of retainer discs 120 and a corresponding selected disc of the second set of retainer discs 130. The concrete penetration patch kit 100 is provided to repair an abandoned penetration hole in a concrete slab.

FIG. 2-5 show perspective views of the concrete penetration patch kit 100 of FIG. 1, according to an embodiment of the present disclosure. As above, the concrete penetration patch kit 100 may include the first set of retainer discs 120 and the second set of retainer discs 130 which may be selected to be used as appropriate. The first set of retainer discs 120 comprises discs ranging from 1 inch to 7 inches in diameter. The second set of retainer discs 130 also comprises discs ranging from 1 inch to 7 inches in diameter. The first set of retainer discs 120 and the second set of retainer discs 130 comprise sheet metal. The first set of retainer discs 120 comprise slices equidistantly spaces along an outer diameter, extending towards a center portion of each of the discs approximately 0.5 inches. This allows the first set of retainer discs 120 to "cup" in the abandoned penetration hole and thereby creates a steel bottom in the abandoned penetration hole. The discs of the first set of retainer discs 120 each comprise at least one center-aperture 122 located at the center portion of each of the discs of the first set of retainer discs 120. The at least one center-aperture 122 is configured to receive one of the at least one setting wires 138.

The discs of the second set of retainer discs 130 each comprise at least one second-disc-center-aperture 132 located at a second-disc-center-portion of each of the discs of the second set of retainer discs 130. In a preferred embodiment, the discs of the second set of retainer discs 130 each comprise 3 or 4 second-disc-center-apertures 132. The 4" in diameter discs of the second set of retainer discs 130 and smaller have 3 second-disc-center-apertures 132 and discs 5" in diameter discs of the second set of retainer discs 130 and larger have 4 second-disc-center-apertures 132 for lacing or weaving one of the at least one setting wires 138. By weaving the setting wire 138 in and out of the second-disc-center-apertures 132 in the discs of the second set of retainer discs 130, a selected disc of the second set of retainer discs 130 is stabilized on the bottom of its setting wire 138 so that it can be held flat or angled to match a shape of a floor structure being patched. The at least one setting wire 138 connects a selected disc of the first set of retainer discs 120 to a selected disc of the second set of retainer discs 130 to prevent the selected disc of the first set of retainer discs 120 from pushing through the abandoned penetration hole being repaired. The setting wires 138 may be cut such that they are readily identifiable during a process of installation. The selected disc of the first set of retainer discs 120 is 0.5 inch larger than the abandoned penetration hole being repaired. The selected one of the second set of retainer discs 130 is 0.5 inch smaller than the abandoned penetration hole being repaired.

Once the setting wire is weaved into the second-disc-center-apertures 132, fireproofing material 160 is applied. Use one scoop of dry fireproofing material 160 per each 1" of abandoned penetration hole size. The kit may include 2 sizes of surgical bandage type elastic tubular netting 170. The netting 170 is provided for holding a portion of the fireproofing material 160. The concrete penetration patch kit 100 further comprises at least one fastener for securing a portion of the netting 170. The fireproofing material 160 is applied to a bottom-surface of the selected disc the first set of retainer discs 120.

In a preferred embodiment the setting tool 110 is provided with 7 different sized setting-heads 112 designed to work with a corresponding size concrete retainer disc as needed for patching penetrations ranging from 1" to 7" in diameter in any depth of concrete slab.

The setting tool 110 may comprise of two 12" long, 0.5" threaded tubes that can be used individually or connected together (with an included coupler) as each application requires. The setting-stem 114 comprises depth control holes 115 at about 0.5 inch increments starting at 3" above a bottom of the setting-head 112 for controlling a depth that the selected disc of the first set of retainer discs 120 is set to. At least one depth control wire 140 is further provided to be used in combination with the setting-stem 114. In a preferred embodiment, the kit includes two depth control wires 140 that may be inserted into an appropriate depth control hole 115 in the setting-stem 114 corresponding with a target depth. When selected discs are being set, and the depth control wire 140 lands on a finish floor, the full depth has been achieved. The first set of retainer discs 120 the second set of retainer discs 130 may be provided separately.

According to one embodiment, the concrete penetration patch kit 100 may be arranged as a kit. The kit may include a set of user instructions. The instructions may detail functional relationships in relation to the structure of the concrete penetration patch kit 100 (such that the concrete penetration patch kit 100 can be used, maintained, or the like, in a preferred manner).

Figure 5:
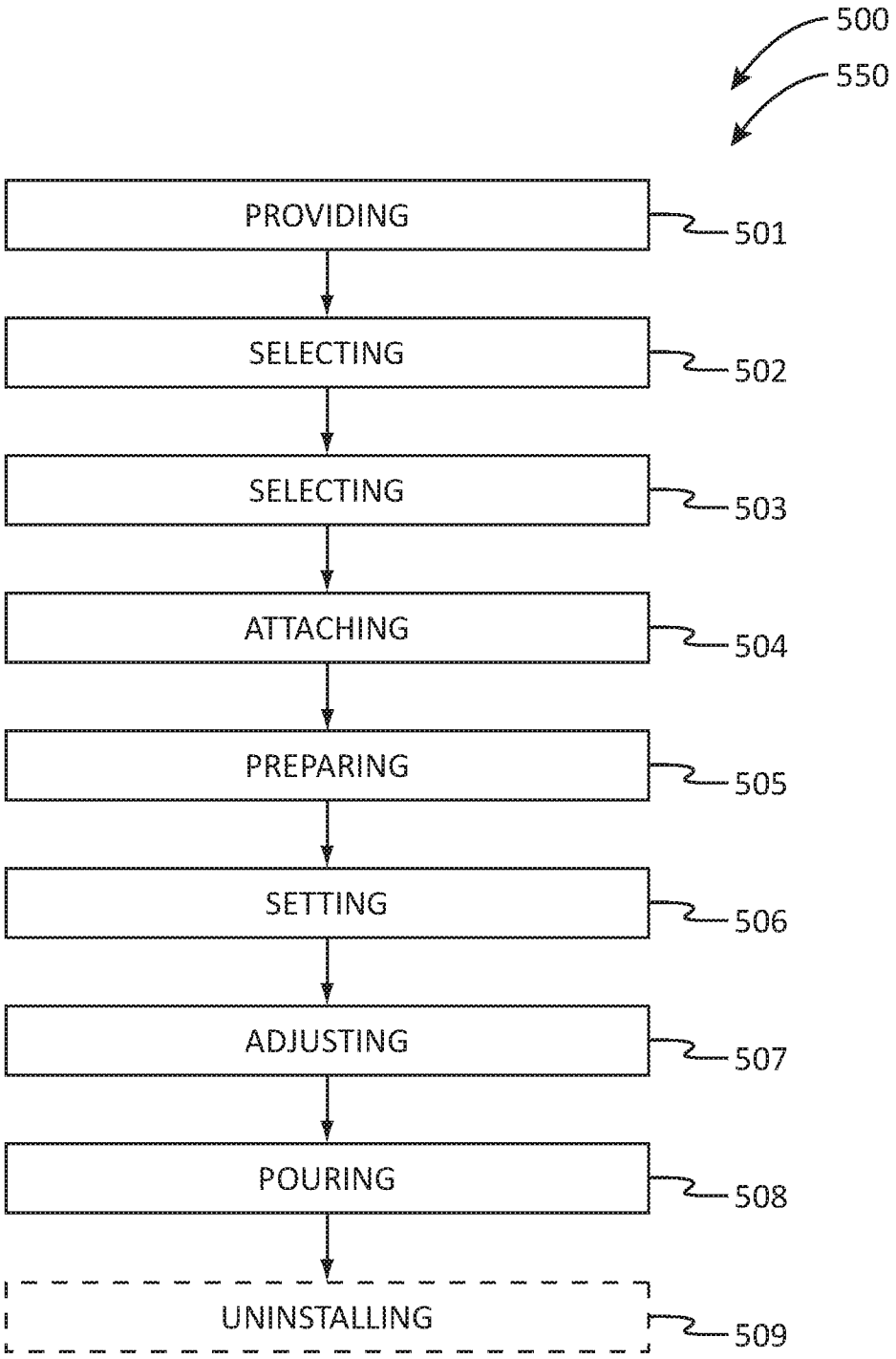
FIG. 5 is a flow diagram illustrating a method of use for the concrete penetration patch kit, according to an embodiment of the present disclosure.

FIG. 5 is a flow diagram 550 illustrating a method of repairing abandoned penetration holes in concrete slabs using a concrete penetration patch kit 500, according to an embodiment of the present disclosure. As illustrated, the method of repairing abandoned penetration holes in concrete slabs using a concrete penetration patch kit 500 may include the steps of: step one 501, providing a concrete penetration patch kit 100 including a setting tool 110 including a setting-head 112, a setting-stem 114, and a drill guide 116, a first set of retainer discs 120, a second set of retainer discs 130, at least one setting wire 138, at least one depth control wire 140, at least one fastener, fireproofing material 160, netting 170, and a rubber mallet; step two 502, selecting an appropriate size first-disc from the first set of retainer discs 120; step three 503, selecting an appropriate size second-disc from the second set of retainer discs 130; step four 504, attaching a second one of the at least one setting wire 138 to the second-disc forming an assembly; step five 505, preparing the netting 138 and the fireproofing material 160; step six 506, setting the assembly including the first-disc and the second-disc within a penetration hole; step seven 507, adjusting and tightening the first-disc and second-disc; step eight 508, pouring cement into the penetration hole; and step nine 509, optionally, uninstalling the concrete penetration patch kit 100.

It should be noted that step nine 509 is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for concrete penetration patch kit 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A concrete penetration patch kit to repair abandoned penetration holes in concrete slabs, said kit comprising:
- a setting tool including;
  - a setting-head;
  - a setting-stem; and
  - a drill guide;
- a first set of retainer discs;
- a second set of retainer discs;
- at least one setting wire;
- fireproofing material; and
- netting;

wherein said concrete penetration patch kit is provided to repair an abandoned penetration hole in a concrete slab.

2. The concrete penetration patch kit of claim 1, wherein said first set of retainer discs comprises discs ranging from 1 inch to 7 inches in diameter.

3. The concrete penetration patch kit of claim 2, wherein said second set of retainer discs comprises discs ranging from 1 inch to 7 inches in diameter.

4. The concrete penetration patch kit of claim 3, wherein said first set of retainer discs and said second set of retainer discs comprise sheet metal.

5. The concrete penetration patch kit of claim 2, wherein said first set of retainer discs comprise slices equidistantly spaces along an outer diameter, extending towards a center portion of each of said discs approximately 0.5 inches.

6. The concrete penetration patch kit of claim 5, wherein said discs of said first set of retainer discs each comprise at least one center-aperture located at said center portion of each of said discs, said at least one center-aperture is configured to receive one of said at least one setting wires.

7. The concrete penetration patch kit of claim 6, wherein said discs of said second set of retainer discs each comprise at least one second-disc-center-aperture located at a second-disc-center-portion of each of said discs, said at least one second-disc-center-aperture is configured to receive one of said at least one setting wires.

8. The concrete penetration patch kit of claim 7, wherein said at least one setting wire connects a selected disc of said first set of retainer discs to a selected disc of said second set of retainer discs to prevent said selected disc of said first set of retainer discs from pushing through said abandoned penetration hole being repaired.

9. The concrete penetration patch kit of claim 8, wherein said selected disc of said first set of retainer discs is 0.5 inch larger than said abandoned penetration hole being repaired.

10. The concrete penetration patch kit of claim 9, wherein said selected one of said second set of retainer discs is 0.5 inch smaller than said abandoned penetration hole being repaired.

11. The concrete penetration patch kit of claim 1, wherein said fireproofing material is applied to a bottom-surface of said selected disc said first set of retainer discs.

12. The concrete penetration patch kit of claim 1, wherein said netting comprises elastic tubular netting.

13. The concrete penetration patch kit of claim 12, wherein said netting is provided for holding a portion of said fireproofing material.

14. The concrete penetration patch kit of claim 1, wherein said setting-stem comprises depth control holes at 0.5 inch increments for controlling a depth that said selected disc of said first set of retainer discs is set to.

15. The concrete penetration patch kit of claim 1, further comprises at least one fastener for securing a portion of said netting.

16. The concrete penetration patch kit of claim 1, further comprises at least one depth control wire to be used in combination with said setting-stem.

17. The concrete penetration patch kit of claim 1, wherein said setting-heads are provided in a variety of sizes to accommodate a corresponding said disc of said first set of retainer discs and a corresponding said disc of said second set of retainer discs.

18. A concrete penetration patch kit, the concrete penetration patch kit comprising:

a setting tool including;
- a setting-head;
- a setting-stem; and
- a drill guide;

a first set of retainer discs;
a second set of retainer discs;
at least one setting wire;
fireproofing material; and
netting;

wherein said concrete penetration patch kit is provided to repair an abandoned penetration hole in a concrete slab;

wherein said first set of retainer discs comprises discs ranging from 1 inch to 7 inches in diameter;

wherein said second set of retainer discs comprises discs ranging from 1 inch to 7 inches in diameter;

wherein said first set of retainer discs and said second set of retainer discs comprise sheet metal;

wherein said first set of retainer discs comprise slices equidistantly spaces along an outer diameter, extending towards a center portion of each of said discs approximately 0.5 inches;

wherein said discs of said first set of retainer discs each comprise at least one center-aperture located at said center portion of each of said discs, said at least one center-aperture is configured to receive one of said at least one setting wires;

wherein said discs of said second set of retainer discs each comprise at least one second-disc-center-aperture located at a second-disc-center-portion of each of said discs, said at least one second-disc-center-aperture is configured to receive one of said at least one setting wires;

wherein said at least one setting wire connects a selected disc of said first set of retainer discs to a selected disc of said second set of retainer discs to prevent said selected disc of said first set of retainer discs from pushing through said abandoned penetration hole being repaired;

wherein said selected disc of said first set of retainer discs is 0.5 inch larger than said abandoned penetration hole being repaired;

wherein said selected one of said second set of retainer discs is 0.5 inch smaller than said abandoned penetration hole being repaired;

wherein said fireproofing material is applied to a bottom-surface of said selected disc said first set of retainer discs;

wherein said netting comprises elastic tubular netting;

wherein said netting is provided for holding a portion of said fireproofing material;

wherein said setting-stem comprises depth control holes at 0.5 inch increments for controlling a depth that said selected disc of said first set of retainer discs is set to;

wherein said concrete penetration patch kit further comprises at least one fastener for securing a portion of said netting;

wherein said concrete penetration patch kit further comprises at least one depth control wire to be used in combination with said setting-stem;

wherein said setting-heads are provided in a variety of sizes to accommodate a corresponding said disc of said first set of retainer discs and a corresponding said disc of said second set of retainer discs.

19. A method of repairing abandoned penetration holes in concrete slabs using a concrete penetration patch kit, the method comprising the steps of:

providing a concrete penetration patch kit including;
- a setting tool including;
  - a setting-head;
  - a setting-stem; and
  - a drill guide;
- a first set of retainer discs;
- a second set of retainer discs;
- at least one setting wire;
- at least one depth control wire;
- at least one fastener;
- fireproofing material;
- netting; and
- a rubber mallet;

selecting an appropriate size first-disc from said first set of retainer discs;

selecting an appropriate size second-disc from said second set of retainer discs;

attaching one of said at least one setting wire to said first-disc;

attaching a second one of said at least one setting wire to said second-disc forming an assembly;

preparing said netting and said fireproofing material;

setting said assembly including said first-disc and said second-disc within a penetration hole;

adjusting and tightening said first-disc and second-disc; and pouring cement into said penetration hole.

20. The method of claim 19, further comprising the steps of:

uninstalling said concrete penetration patch kit.

* * * * *